US007793384B1

(12) United States Patent
Kerr

(10) Patent No.: US 7,793,384 B1
(45) Date of Patent: Sep. 14, 2010

(54) RETRACTABLE CENTRAL VACUUM HOSE

(76) Inventor: Michele A. Kerr, 14832 E. Delgado Dr., Fountain Hills, AZ (US) 85268

( * ) Notice: Subject to any disclaimer, the term of this patent is extended or adjusted under 35 U.S.C. 154(b) by 0 days.

(21) Appl. No.: 12/399,201

(22) Filed: Mar. 6, 2009

Related U.S. Application Data

(60) Provisional application No. 61/034,338, filed on Mar. 6, 2008.

(51) Int. Cl.
*A47L 5/38* (2006.01)

(52) U.S. Cl. ..... 15/315

(58) Field of Classification Search ..... 15/314, 15/315; *A47L 5/38*
See application file for complete search history.

(56) References Cited

U.S. PATENT DOCUMENTS 2,953,806 A * 9/1960 Walker ..... 15/315
5,526,842 A * 6/1996 Christensen ..... 137/360
7,010,829 B2 * 3/2006 Harman et al. ..... 15/315

* cited by examiner

*Primary Examiner*—David A Redding
(74) *Attorney, Agent, or Firm*—Kenneth L Tolar

(57) ABSTRACT

A retractable hose assembly for a central vacuum system includes a PVC conduit mounted behind a wall within at least one room on each floor of a building. The conduit includes an elbow at a lower end that extends to the outlet of a wall-mounted vacuum receptacle. Received within the conduit is an elongated, length-extendable hose formed of helical spring wire encompassed by a flexible layer. The helical wire allows the hose to be manually extended to approximately six times its collapsed length. When the hose is released, it retracts completely within the conduit with its inlet concealed behind the wall-mounted receptacle. By simply pulling the hose from the conduit, a user can extend it significantly to access one or more rooms on a given level.

8 Claims, 3 Drawing Sheets

RETRACTABLE CENTRAL VACUUM HOSE

CROSS REFERENCE TO RELATED APPLICATIONS

This application is entitled to the benefit of provisional application No. 61/034,338 filed on Mar. 6, 2008, the specification of which is incorporated herein by reference.

BACKGROUND OF THE INVENTION

The present invention relates to a retractable vacuum hose for a central vacuum system.

DESCRIPTION OF THE PRIOR ART

Many buildings have a central vacuum system including a vacuum source in communication with a wall outlet mounted within each room. To vacuum a room, a user connects a hose to the outlet mounted therein. To vacuum a second room, the user must disconnect the hose and reconnect it to the outlet in the second room, which is laborious and inconvenient. Accordingly, there is currently a need for an easier means of operating a central vacuum system. The present invention addresses this need by providing a central vacuum hose that can be conveniently retracted within a wall, and which is extendable therefrom to reach each of several rooms on a given level.

SUMMARY OF THE INVENTION

The present invention relates to a retractable hose assembly for a central vacuum system. The assembly includes a PVC conduit mounted behind a wall within at least one room on each floor of a building. The conduit includes an elbow at a lower end that extends to the outlet of a wall-mounted vacuum receptacle. Received within the conduit is an elongated, length-extendable hose formed of helical spring wire encompassed by a flexible, vinyl-plastic layer. The helical wire allows the hose to be manually extended to approximately six times its collapsed length. When the hose is released, it retracts completely within the conduit with its inlet concealed behind the wall-mounted receptacle. A user simply extends the hose from the conduit to access one or more rooms on a given level.

It is therefore an object of the present invention to provide a vacuum hose that eliminates the burden and inconvenience associated with conventional central vacuum systems.

It is another object of the present invention to provide a vacuum hose that may be conveniently retracted within and extended from a wall.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
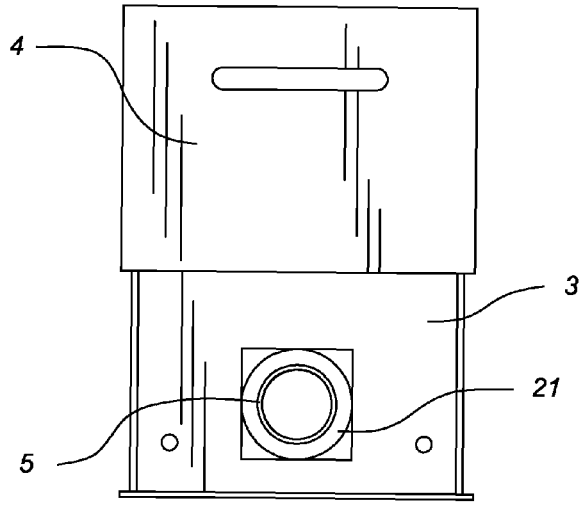
FIG. 2 is a front, plan view of the wall-mounted receptacle.
Figure 1:
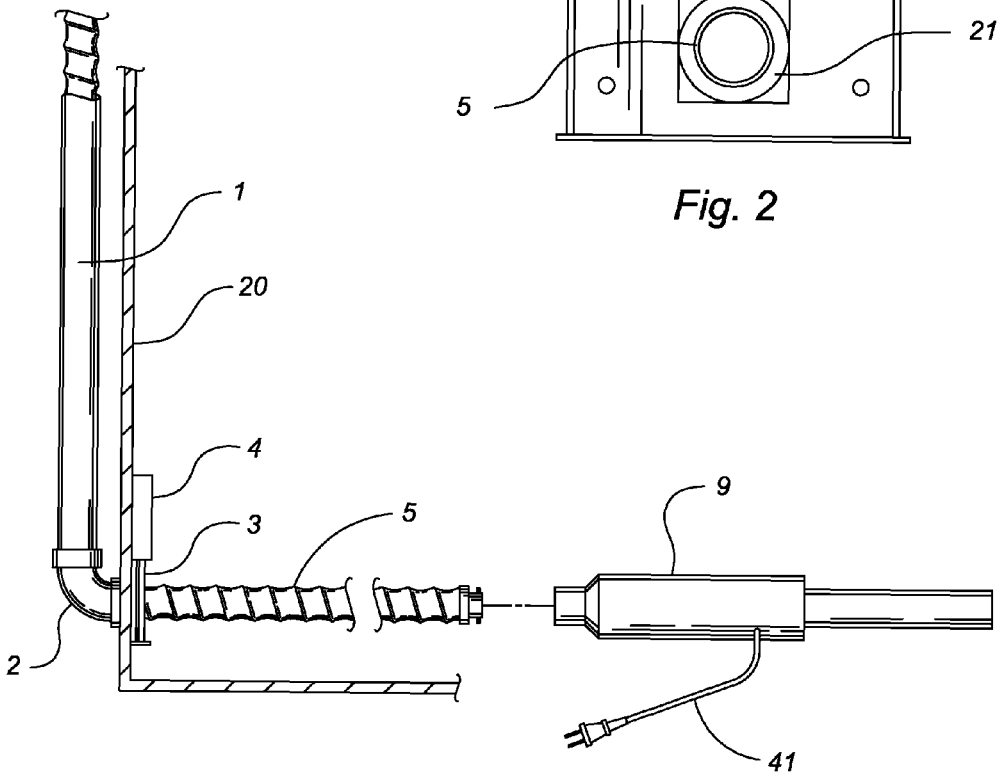
FIG. 1 is a side view of the retractable hose assembly according to the present invention.
Figure 3:
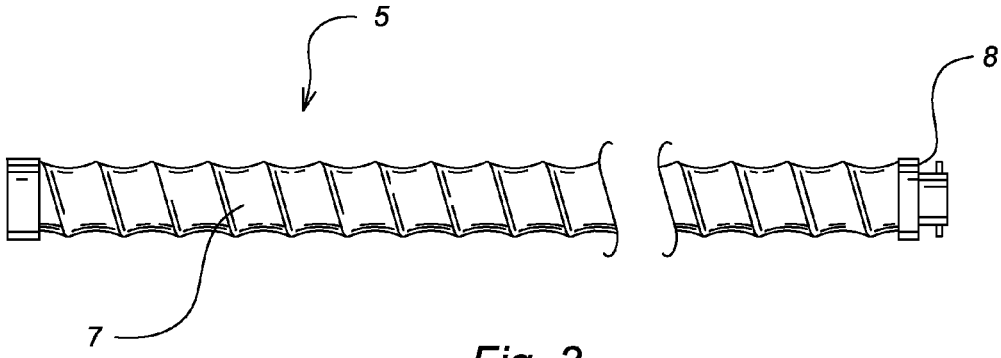
FIG. 3 is a detailed view of the hose.
Figure 4:
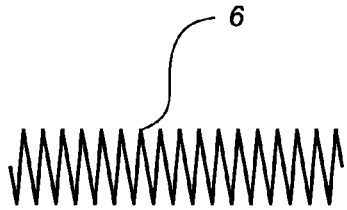
FIG. 4 is an isolated view of the helical spring wire in a collapsed orientation.
Figure 5:
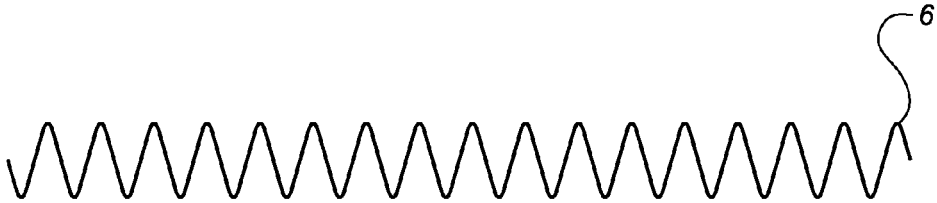
FIG. 5 is an isolated view of the wire in an expanded orientation.
Figure 6:
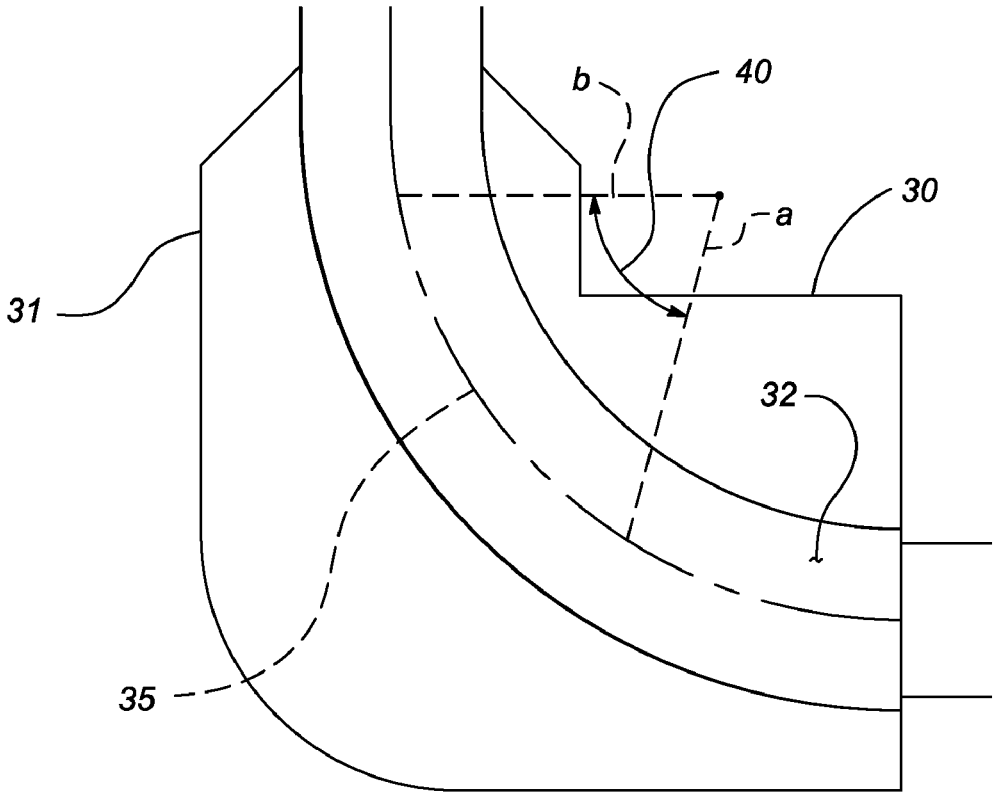
FIG. 6 depicts the elbow and internal hose passageway.

The present invention relates to a retractable hose assembly for a central vacuum system. The assembly includes a PVC conduit 1 mounted behind a wall 20 within at least one room on each floor or level of a building. The conduit includes an elbow 2 at a lower end that extends to an outlet on a wall-mounted vacuum receptacle 3. The receptacle includes a slidable cover 4 that is locked in either a raised or lowered position. On the inner surface of the cover is a plug or gasket that mates with a fitting 21 at the distal end of the elbow to form an air-impermeable seal.

Received within the conduit is an elongated, length-extendable hose 5 formed of a helical spring wire 6 encompassed by a flexible, vinyl-plastic layer 7. The helical wire allows the hose to be manually extended to approximately six times its collapsed length. When the hose is released, it automatically retracts completely within the conduit where the hose inlet 8 is concealed behind the wall-mounted receptacle. By simply grasping and pulling the hose, a user can extend it significantly to access an entire floor.

To prevent the hose from binding during extension and retraction, the elbow preferably includes an arcuate passageway 32 having a central axis that forms the arcuate circumference 35 of an imaginary sector 40 defined by radii a,b; the unique passageway allows the hose to travel smoothly between the horizontal portion 30 of the elbow that is connected to the receptacle and the perpendicular, vertical portion 31 that is connected to the conduit. The conventional ninety-degree passageway formed through most elbows could restrict extension and retraction of the hose.

An adapter 9 is securable to the hose inlet allowing the retractable hose to be used with virtually any conventional central-vacuum attachment. Preferably, the adapter includes a jumper cord 41 for electrically-powered vacuum attachments. Optionally, powered hoses can be used wherein an electrical cord is intertwined with the helical wire.

In addition, the device preferably includes a restraining mechanism that prevents the hose from retracting whenever a vacuum is applied thereto; due to the collapsible nature of the hose, the central vacuum source will bias the hose toward a collapsed orientation thereby placing additional strain on the user. The restraining mechanism includes a spring-biased gripping finger that is normally disengaged from the hose. Once the hose is extended a predetermined distance, a measuring wheel pivots the finger into engagement with the hose preventing its retraction. A release lever retracts the finger allowing the hose to retract within the conduit.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A retractable hose assembly for a central vacuum system comprising:

a conduit mounted behind a vertical wall within a room, said conduit having an upper end and a lower end;

a vacuum source connected to the upper end of said conduit;

a receptacle attached to said wall, said receptacle having an outlet in fluid communication with the lower end of said conduit;

a collapsible hose received within said conduit and in communication with said vacuum source, said hose having an inlet that is extended from said conduit to access a given floor space;

an elbow extending from the lower end of said conduit to the outlet on said receptacle, said elbow including a vertical portion, and a horizontal portion perpendicularly extending therefrom, said elbow further including an arcuate passageway formed therein that extends from said outlet to the lower end of said conduit allowing said hose to gradually transform between a vertical direction and a horizontal direction with minimal interference allowing the conduit to be positioned behind a vertical wall.

2. The hose assembly according to claim 1 wherein said receptacle includes a slidable cover that is locked in either of a raised and a lowered position to selectively expose the outlet on said receptacle.

3. The hose assembly according to claim 2 wherein said hose is formed of a helical wire encompassed by a flexible layer.

4. The hose assembly according to claim 3 further comprising an adapter securable to the inlet of said hose, said adapter configured to couple with a central vacuum attachment.

5. The hose assembly according to claim 4 further comprising a plug on an inner surface of the cover that mates with a fitting on said elbow to form an air-impermeable seal.

6. The hose assembly according to claim 5 wherein said adapter includes a jumper cord for electrically-powered vacuum attachments.

7. The hose assembly according to claim 6 further comprising an electrical cord intertwined with said helical wire.

8. The hose according to claim 1 wherein said arcuate passageway has a central axis that forms an arcuate circumference of an imaginary sector defined by a pair of radii extending from a point spaced a predetermined distance from said elbow.

* * * * *